United States Patent [19]

Fritchle et al.

[11] 4,292,567

[45] Sep. 29, 1981

[54] IN-BAND RESONANT LOSS IN TWT'S

[75] Inventors: Cliff D. Fritchle, Mountain View; Charles E. Hobrecht, Sunnyvale; Allan W. Scott, Los Altos, all of Calif.

[73] Assignee: Varian Associates, Inc., Palo Alto, Calif.

[21] Appl. No.: 97,995

[22] Filed: Nov. 28, 1979

[51] Int. Cl.[3] ..... H01J 25/34

[52] U.S. Cl. ..... 315/3.5; 315/3.6; 315/39.3

[58] Field of Search ..... 315/3.5, 3.6, 39.3

[56] References Cited

U.S. PATENT DOCUMENTS

| | | | |
|---|---|---|---|
| 3,389,291 | 6/1968 | Ruetz | 315/3.6 |
| 3,397,339 | 8/1968 | Beaver et al. | 315/3.5 |
| 3,693,038 | 9/1972 | Scott et al. | 315/3.5 |
| 3,903,449 | 9/1975 | Scott et al. | 315/3.6 |
| 4,107,575 | 8/1978 | Vanderplaats | 315/3.6 |
| 4,158,791 | 6/1979 | Lien et al. | 315/3.6 |

*Primary Examiner*—Saxfield Chatmon, Jr.
*Attorney, Agent, or Firm*—Stanley Z. Cole; Peter J. Sgarbossa

[57] ABSTRACT

In traveling wave tubes with broad bandwidth, such as an octave or more, the gain varies by many dB across the band. One or more lossy circuits inside the tube coupled to the interaction helix-type slow-wave circuit are resonant at frequencies within the operating band. They provide a loss varying with frequency to compensate for the gain variation. The resonant circuits are typically metallized patterns on a dielectric rod which may be a support rod for the interaction circuit. Compared to an external gain equilizer in the drive circuit of the TWT, the internal equalizer is cheaper and provides a better noise figure.

20 Claims, 4 Drawing Figures

IN-BAND RESONANT LOSS IN TWT'S

DESCRIPTION

1. Field of the Invention

The invention pertains to traveling wave tubes (TWT's) having wide bandwidth. Such tubes use helix-type slow-wave interaction circuits and typically have large variations of small-signal gain over their operating frequency band.

2. Prior Art

The accepted way of equalizing the gain of a TWT is to insert in its drive signal line a passive network of resistances, capacitances and inductances chosen to provide a loss varying with frequency the same as the intrinsic gain of the TWT varies. Such equalizers are described in U.S. Pat. No. 3,510,720 issued May 5, 1970 and No. 3,548,344 issued Dec. 15, 1970, both to J. L. Putz and co-assigned with this application. There are several disadvantages to these prior-art external equalizers. They are expensive and sometimes quite bulky. Also, they have to be in the drive signal line because if they were in the output they would ruin the saturation characteristic of the TWT. That is, if the TWT output were saturated at frequencies of low gain it would be greatly oversaturated at frequencies of high gain. But with the equalizing attenuator in the drive line the tube's drive signal is greatly attenuated at high-gain frequencies. The tube noise, however, is independent of drive level, so the signal-to-noise ratio goes down at the high-gain frequencies.

U.S. Pat. No. 4,158,791 issued June 19, 1979 to Erling L. Lien and A. W. Scott and co-assigned with the present application describes lossy attenuators attached to dielectric rods in a helix-type TWT which are resonant at a frequency where oscillations are possible, such as the "Backward Wave Oscillation" frequency where the phase shift is 180 degrees per helix turn. These frequencies are outside the operating band of the TWT, so all that is needed is enough attenuation. The application of lossy resonators to in-band attenuation for equalizing the gain is a new concept.

SUMMARY OF THE INVENTION

An object of the invention is to provide a gain equalizer for a helix-type TWT incorporated within the tube structure.

A further object is to provide an inexpensive equalizer.

A further object is to provide an equalizer which does not degrade the signal-to-noise ratio.

These objects are achieved by making the equalizer as one or more lossy resonant circuits attached to a dielectric rod located near the helix-type interaction circuit. The lossy circuits are resonant at or near the frequencies at which the TWT has its highest intrinsic gain, typically near the center frequency of its operating band. The lossy circuits may be resonant lengths of slow-wave transmission line affixed to the rod. The rod may be one used to support the interaction circuit within the tube envelope.

DESCRIPTION OF THE PREFERRED EMBODIMENTS

Figure 1:
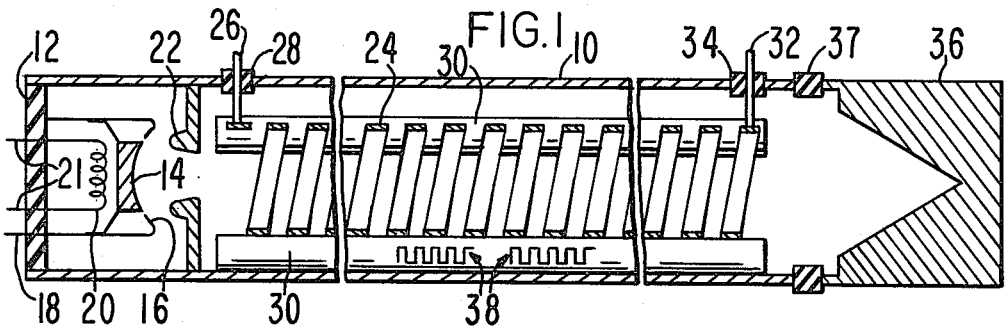
FIG. 1 is a schematic section of a TWT embodying the invention.

FIG. 1 showes a TWT with a helical slow wave circuit, which is the commonly used circuit for low-power wide-band tubes. The tube has a hollow cylindrical metallic vacuum envelope 10 closed at the input end by a cathode insulator 12. A thermionic cathode 14 is supported on a beam-focusing electrode 16 which in turn is supported on insulator 12 with a metal lead-thru 18 for supplying the cathode emission current. A radiant cathode heater coil 20 is mounted on heater leads 21. In front of cathode 14 is a beam-accelerating anode 22 connected to envelope 10 which typically is operated at ground potential. A negative voltage applied to cathode 14 via lead 18 projects a cylindrical electron beam down the axis of the tube. Interaction circuit 24 is a helix wound of flat tape surrounding the beam. The input drive rf signal is brought to the upstream end of helix 24 by a lead 26 passing through a dielectric window 28. Helix 24 is supported inside envelope 10 by several dielectric rods 30 which, having pressure contact with envelope 10 and helix 24, also serve to remove heat from helix 24. The amplified output signal is taken from the downstream end of helix 24 by a lead 32 passing out through a dielectric window 34 in the vacuum envelope. After leaving helix 24 the spent electron beam strikes a metallic collector 36 which is mounted on a dielectric seal 37 to close the vacuum envelope.

Figure 3:
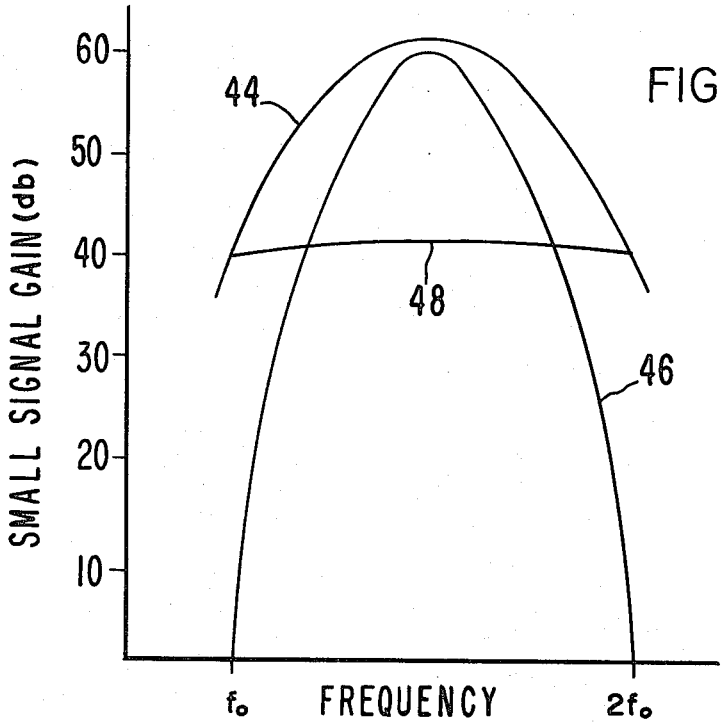
FIG. 3 is a graph of the gain of a TWT.

A TWT with wide frequency bandwidth such as an octave or more may have a variation in gain over its band of 20 dB or more, as illustrated by curve 44 of FIG. 3. According to the invention, the gain is reduced at frequencies where it is high by one or more lossy resonant circuits 38 attached to one or more dielectric rods extending in the direction of helix 24. In the tube of FIG. 1 these are the rods 30 which support helix 24, although they could be separate rods. Lossy circuits 38 are sections of slow-wave transmission line extending in the direction of the axis of helix 24, open-circuited at both ends to form half-wavelength resonant circuits at the chosen frequency. Circuits 38 are, in this example, formed by depositing a metallizing layer in the pattern of a "meander line". However, other types of slow-wave transmission line may be used, such as sections of wire helices glazed to the rods. Alternatively, lumped resonators such as open rings of metal may be used. The number of lossy circuits 38 is chosen to supply the proper distribution of loss-vs-frequency. The bandwidth of the loss is determined by the rf resistivity of the metallized conductors and the thickness of the conducting strip 39. In some cases lossy circuits having a variety of resonant frequencies may be incorporated in a TWT to achieve the desired loss profile.

Lossy circuits 38 are not located near the input 26. The rf wave is first amplified, establishing the noise properties of the tube as good as without an equalizer. Then farther down the tube the attenuation is introduced where it will not degrade the noise properties.

Figure 2:
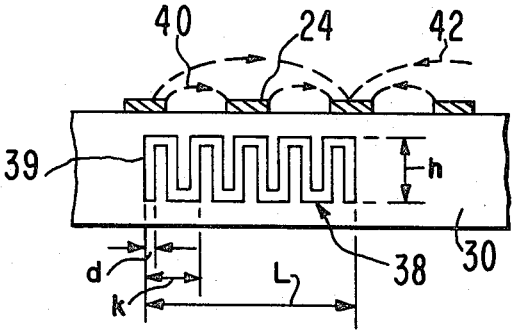
FIG. 2 is an enlarged portion of FIG. 1.

FIG. 2 is an enlarged view of a portion of FIG. 1 showing a single lossy resonator 38. The overall length L of meander line is chosen to be approximately twice the pitch of interaction helix 24. The operating band of a helix TWT is approximately centered at a frequency where the rf phase shift per helix turn is 90 degrees. Thus two turns represent 180 degrees, and correspond to the distance over which the instantaneous rf electric field reverses. Dotted lines 40, 42 show electric field lines frozen at one instant. The whole pattern of course moves with the slow-wave velocity. By having the meander line $\frac{1}{2}$ wavelength long (L) the maximum coupling to the interaction circuit 24 is obtained, for frequencies near the center of the band. However, it may be desirable to achieve maximum loss at other frequencies, by making the lossy resonator between one and three times the pitch or periodic length of the interaction circuit.

In a meander line, similarly to a helix, the local component wave follows the meandering conductor. The pitch k and height h are chosen to make the total meandering length, corrected for dielectric loading, a half-wavelength for the given over-all length L.

FIG. 3 illustrates how the internal attenuators 38 can equalize the TWT gain. Upper curve 44 is a plot in decibels (dB) of the typical small-signal gain of a helix TWT over one octave of operating bandwidth between $f_o$ and $2f_o$. The 20 dB variation is typical.

For an attenuator on the interaction circuit of a TWT, the loss of small-signal gain is about $\frac{1}{3}$ of the loss experienced by the "cold" circuit without the electron beam. Therefore the cold loss required to equalize the 20 dB intrinsic gain variation has a maximum value of 60 dB. This cold loss is plotted as curve 46. The resulting equalized small signal gain of about 40 dB is shown by curve 48.

Figure 4:
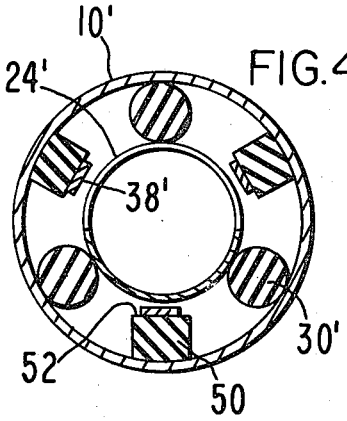
FIG. 4 is a schematic section of an embodiment slightly different from that of FIG. 1.

FIG. 4 is a section perpendicular to the axis of a TWT with a somewhat different embodiment of the invention. Here the lossy resonant circuits 38' are not affixed to the helix support rods 30' but are formed on the surfaces of other axial dielectric rods 50. By placing circuits 38' on surfaces 52 closely facing interaction circuit 24' the coupling therebetween can be increased because the rf fields outside helix 24' fall off rapidly with distance from it.

It will be obvious to those skilled in the art that many variations may be made within the true scope of the invention. Many different types of resonant circuits may be affixed to the dielectric rods, both sections of transmission lines and lumped circuits. The embodiments described above are intended to be exemplary and not limiting. The scope of the invention is to be limited only by the following claims and their legal equivalents.

We claim:

1. A traveling wave tube having internal gain reduction comprising:

a helix-type slow-wave circuit for interaction with a linear electron beam over a selected band of frequencies, said interaction tending to produce a gain which varies with frequency over said band, a dielectric rod near said circuit extending in the direction of the axis of said slow-wave circuit, and resonant resistive conductor means attached to the surface of said rod, the resonance bandwidth of said means including a substantial portion of said selected band, whereby said gain varying with frequency is reduced internally over a substantial portion of said band.

2. The tube of claim 1 wherein said means comprises a single conductor.

3. The tube of claim 1 wherein said rod is a support rod for said slow-wave circuit.

4. The tube of claim 2 wherein said resistive conductor is a metallized pattern on said surface of said rod.

5. The tube of claim 2 wherein said resistive conductor is a slow-wave circuit extending in the direction of said rod and having wave-reflective ends.

6. The tube of claim 5 wherein said slow-wave circuit is a meander line.

7. The tube of claim 2 wherein said conductor means comprises a plurality of resistive conductors.

8. The tube of claim 7 wherein at least one of said plurality has a resonant frequency different from another of said plurality.

9. The tube of claim 7 wherein at least one of said plurality has a Q-factor different from another of said plurality.

10. The tube of claim 5 wherein said resistive conductor extends over an axial distance larger than the periodic length of said interaction circuit.

11. The tube of claim 10 wherein said axial distance is between one and three times said periodic length.

12. The tube of claim 11 wherein said axial distance is approximately twice said periodic length.

13. The tube of claim 1 wherein said resonant means couples into said interaction means over at least a portion of said band, a loss, varying with frequency, by an amount sufficient to approximately compensate the variation of gain with frequency of the tube without said resonant circuit.

14. The tube of claim 7 wherein the combination of resistive conductors couples into said interaction circuit over at least a portion of said band, a loss varying with frequency by an amount to approximately compensate the variation of gain with frequency of the tube without said resistive conductors.

15. The tube of claim 14 wherein said portion of said band is one octave.

16. A traveling wave tube with reduced gain variation comprising:

a helix-type slow-wave circuit for interaction with a linear electron beam over a selected band of frequencies, said interaction tending to produce a gain which varies with frequency; and means within said tube and adjacent said slow-wave circuit for electromagnetically coupling thereinto, over a plurality of frequencies within said band comprising at least a portion of said band, a loss which varies with frequency so as to approximately compensate said variations in gain.

17. The tube of claim 16 wherein said means includes a plurality of resonant circuits whose loss-vs-frequency characteristic approximately matches said variations in gain.

18. The tube of claim 16 wherein said slow-wave circuit has an input end and said means are spaced away from said input end so as not to degrade the noise properties of said tube.

19. The tube of claim 16 wherein said resonant means achieves maximum coupling for frequencies near the center of said band.

20. A traveling wave tube having internal gain compensation which does not degrade the noise properties thereof, comprising:

a helix-type slow-wave circuit having an input end for microwave signals, said signals interacting with a linear electron beam over a selected band of frequencies, said interaction tending to produce a gain which varies with frequency, a dielectric rod near said circuit extending in the direction of the axis of said slow-wave circuit; and a resistive conductor for introducing attenuation shaped to form a circuit with a resonant frequency within said band, said conductor being attached to the surface of said rod and spaced away from said input end so that the noise properties established when said signals are first amplified are as good as in the absence of said conductor, said attenuation being effected without degrading said noise properties.

* * * * *